US005573278A

United States Patent [19]

Clemens

[11] Patent Number: 5,573,278

[45] Date of Patent: Nov. 12, 1996

[54] IDENTIFICATION AND INFORMATION CARRYING ASSEMBLY

[76] Inventor: Robert M. Clemens, 3441 Damascus Rd., Brookeville, Md. 20833

[21] Appl. No.: 355,040

[22] Filed: Dec. 13, 1994

[51] Int. Cl.[6] ..... B42D 15/00

[52] U.S. Cl. ..... 283/109; 283/75

[58] Field of Search ..... 283/74, 75, 76, 283/78, 79, 109, 112, 900

[56] References Cited

U.S. PATENT DOCUMENTS

| | | | |
|---|---|---|---|
| 3,068,140 | 12/1962 | Biddle . | |
| 3,958,690 | 5/1976 | Gee, Sr. | 283/900 X |
| 4,553,670 | 11/1985 | Collens | 283/900 X |
| 4,632,428 | 12/1986 | Brown | 283/900 X |
| 4,648,189 | 3/1987 | Michel | 283/109 X |
| 4,991,878 | 2/1991 | Cowan et al. | 283/81 |
| 5,380,046 | 1/1995 | Stephens | 283/109 X |

*Primary Examiner*—Willmon Fridie, Jr.
*Attorney, Agent, or Firm*—Donald A. Kettlestrings

[57] ABSTRACT

An identification and information carrying assembly for use with a fire/rescue personnel accountability system includes a folded sheet of information-carrying material covered and sealed within transparent thermoplastic laminates. A cord is attached to the laminates, and a connector is attached to the cord for enabling the assembly to be removably fastened to fire/rescue helmets, clothing or other objects. Confidential medical information and/or medication contained within the folded sheet of laminated material is accessed by cutting the laminates along three edges of the folded sheet to permit the folded sheet to open like a book. The folded sheet of material can be resealed by use of clear adhesive tape along the three edges, and the confidential medical information and/or medication can be accessed again and again by such cutting and resealing.

8 Claims, 2 Drawing Sheets

IDENTIFICATION AND INFORMATION CARRYING ASSEMBLY

BACKGROUND OF THE INVENTION

This invention relates to an identification and information carrying assembly and more particularly to such an assembly for use with a fire/rescue personnel accountability system.

Fire/rescue personnel safety and accountability are important considerations at the scene of an incident. It is important to keep track of fire/rescue personnel as they travel to and from incidents and as they perform services at incident scenes. It is also important to have readily available medical information about fire/rescue personnel who may be injured or otherwise incapacitated at an incident scene or while en route to or from an incident. Information such as allergies, medications being taken, medical history, blood type, normal blood pressure, normal pulse rate, birth date, emergency contact person's name and telephone number, physician's name and telephone number and other information will assist in promptly treating a sick or injured fire/rescue person. It may also be important to have emergency medication immediately available to treat fire/rescue personnel who suffer from illness or allergic reactions to bees, other insects or substances and who might suffer serious or even fatal consequences if their emergency medication was not immediately available.

It is, therefore, an object of the present invention to provide an identification and information carrying assembly for use by fire/rescue personnel.

Another object is to provide such an assembly for use with a fire/rescue personnel accountability system.

A further object of the invention is the provision of such an assembly which contains personal medical information that is maintained in a confidential manner until the information is accessed by the use of scissors or another cutting implement.

Still another object is to provide such an assembly which can be quickly and easily fastened to and unfastened from fire/rescue helmets, clothing and other objects.

Yet another object of the present invention is the provision of such an assembly which contains medication that can be quickly and easily accessed by the use of scissors or other cutting implements.

Another object is to provide such an assembly which includes confidential medical information in printed form, on micro film or micro fiche, on a laser disk or on a computer program or computer chip which can be quickly and easily accessed by the use of scissors or other cutting implements.

Still another object is to provide a method of accessing confidential personal medical information contained within an identification and information carrying assembly.

A still further object is to provide a method of manufacturing an identification and information carrying assembly.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides an identification and information carrying assembly for use with a fire/rescue personnel accountability system, the assembly comprising: a folded sheet of predetermined material defining first and second portions connected together along a folded edge in the material, each of the first and second portions further defining three additional edges; the first and second portions each defining front and rear surfaces, the rear surface of the first portion facing and in contact with the front surface of the second portion when the first and second portions are folded together in closed relationship about the folded edge; personal identification information located on the front surface of the first portion and/or on the rear surface of the second portion; personal medical information located on the rear surface of the first portion and/or on the front surface of the second portion; a first transparent sheet of thermoplastic material covering and extending beyond the edges of the first portion, and a second transparent sheet of thermoplastic material covering and extending beyond the edges of the second portion, the first and second sheets fused together along margins thereof adjacent to the edges of the first and second portions; the fused transparent sheets defining an opening within a predetermined one of the fused margins adjacent to the folded edge; a cord extending through the opening and fastened to the transparent sheets; and a connector attached to the cord.

To further achieve the objects of the invention there is provided a method of accessing personal medical information contained within the assembly of this invention, the method comprising the steps of: cutting portions of the assembly substantially along but within the three additional edges of the first and second portions; removing the cut portions from the assembly; and opening the first and second portions about the folded edge to expose the personal medical information to view.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENT

Figure 1:
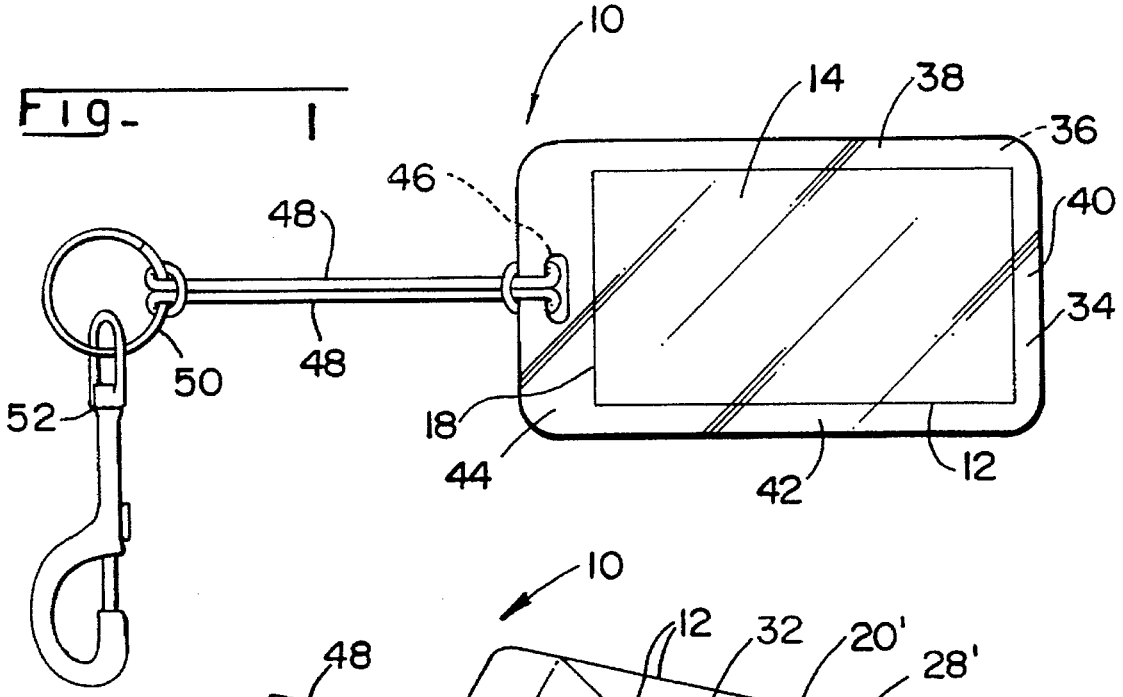
FIG. 1 is a plan view of the assembly in accordance with the invention.

With reference now to the drawings, wherein like reference characters designate like or corresponding parts throughout the several views, there is shown an identification and information carrying assembly 10 for use with a fire/rescue personnel accountability system. In accordance with the invention, assembly 10 includes a folded sheet 12 of predetermined material, such as paper, cardboard or plastic, which defines first and second portions 14, 16 connected together along a folded edge 18 in the material. Each of portions 14, 16 further defines three additional edges 20, 22, 24 and 20', 22', 24', respectively.

Figure 4:
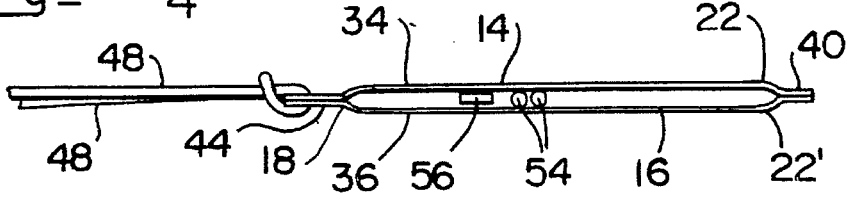
FIG. 4 is a fragmentary side elevation view showing the assembly in FIG. 1 which includes medication and micro film, micro fiche, a laser disk or other information containing medium located within the folded sheet of material.

Each of portions 14, 16 defines front and rear surfaces 26, 28 and 26', 28', respectively. Rear surface 28 of first portion 14 faces and is in substantial contact with front surface 26' of second portion 16 when portions 14, 16 are folded together in closed relationship about folded edge 18. This is illustrated in FIG. 4.

Personal identification information 30 in printed or written form is located on front surface 26 of first portion 14 and/or on rear surface 28' of second portion 16. Personal medical information 32 is located on rear surface 28 of first portion 14 and/or on front surface 26' of second portion 16. The personal medical information may be printed or written.

A first transparent sheet 34 of thermoplastic material covers and extends beyond edges 18, 20, 22, 24 of first portion 14, and a second transparent sheet 36 of thermoplastic material covers and extends beyond edges 18, 20', 22', 24' of second portion 16. Sheets 34, 36 are fused together by heat in a conventional manner along margins 38, 40, 42, 44 thereof adjacent to edges 20, 22, 24, 18 and 20', 22', 24', 18 of portions 14, 16.

Fused transparent sheets 34, 36 define an opening 46 within fused margin 44 adjacent to folded edge 18, and a cord 48 extends through opening 46 and is tied or otherwise fastened to sheets 34, 36.

In accordance with a preferred embodiment of the invention, cord 48 is tied or otherwise attached to a ring 50, and a connector 52 is attached to cord 48 via ring 50, which is attached between cord 48 and connector 52. Alternatively, connector 52 could be connected directly to cord 48. Ring 50 is preferably a conventional split ring, and connector 52 is preferably a conventional round eye swivel snap.

Figure 3:
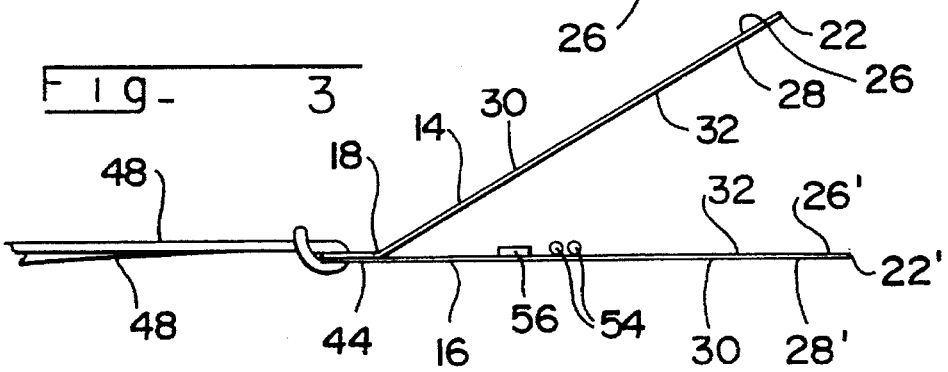
FIG. 3 is a fragmentary side elevation view of the assembly shown in FIG. 2 and illustrating an embodiment which includes medication and micro film, micro fiche, a laser disk or other information containing medium located within the folded sheet of material.

In accordance with the invention, assembly 10 preferably includes medication 54, such as a pill or pills, positioned and removably held between folded portions 14, 16, as illustrated in FIGS. 3 and 4. In addition, assembly 10 may include an information-containing micro film, micro fiche, laser disk, computer chip and/or a computer program 56 positioned and removably held between folded portions 14, 16. Medical and/or other information may also be positioned or stored within assembly 10 by means of a bar code (not shown) which can be located on any one of surfaces 26, 26', 28 or 28'.

Assembly 10 is manufactured by providing a sheet 12 of predetermined material, such as paper, cardboard or plastic. Personal identification information 30 is placed or imprinted onto front surface 26 of first portion 14 and/or onto rear surface 28' of second portion 16. Personal medical information 32 is placed or imprinted onto rear surface 28 of first portion 14 and/or onto front surface 26' of second portion 16.

Sheet 12 is folded along edge 18 to form portions 14, 16, which are connected together along folded edge 18. Portions 14, 16 are positioned into closed relationship with each other by folding portions 14, 16 together about folded edge 18. If medication 54 and/or element or elements 56 are to be incorporated into assembly 10, they are also placed between folded portions 14, 16 prior to positioning portions 14, 16 in closed relationship with each other.

First transparent sheet 34 of thermoplastic material is then placed over and extends beyond the edges of first portion 14. Second transparent sheet 36 of thermoplastic material is similarly placed over and extends beyond the edges of second portion 16. Sheets 34, 36 are then fused together by heat in a conventional manner along margins 38–44. Opening 46 is formed within fused margin 44 adjacent to folded edge 18, and cord 48 is positioned through opening 46 and is attached to sheets 34, 36. Connector 52 is then attached to cord 48 by means of split ring 50.

In operation and use of assembly 10, an individual fire/rescue person places personal identification information 30 and personal medical information 32 onto sheet 12. Transparent sheets 34, 36 are then heat-sealed over folded sheet 12 by the fire/rescue person. In this manner, the personal medical information 32 contained on surfaces 26', 28 is sealed from view within folded sheet 12 and is maintained confidential.

Figure 5:
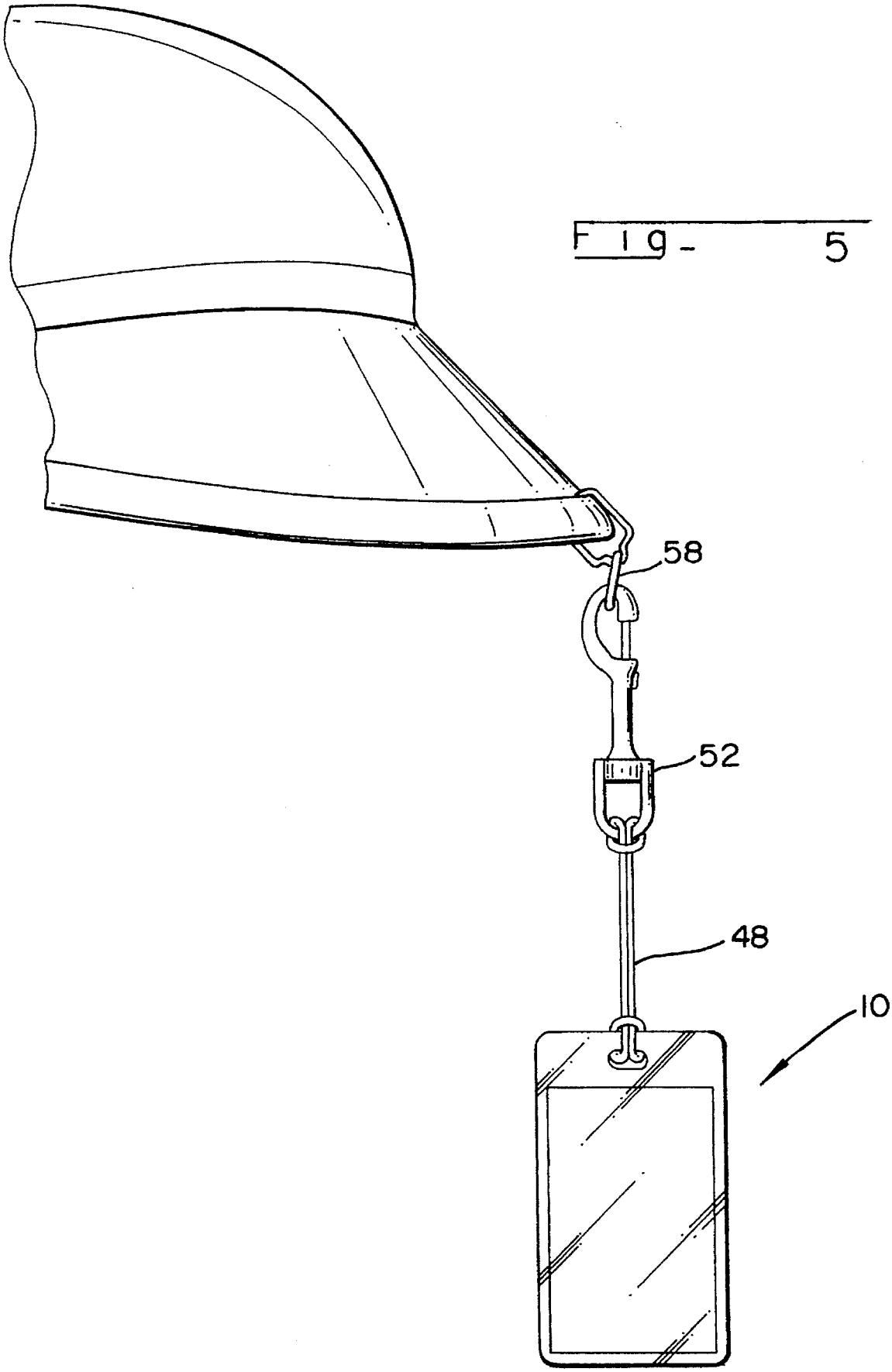
FIG. 5 is a fragmentary perspective view showing the assembly of FIG. 1 attached to a conventional fire/rescue helmet.

Assembly 10 may then typically be fastened by connector 52 to a conventional ring 58 (see FIG. 5) on the rear of a fire/rescue helmet. This would be considered the primary site to attach assembly 10 when not in use. Assembly 10 looks like a "pony tail" when so attached to a helmet to provide assembly 10 with high visibility. This reduces the chance of the fire/rescue person forgetting assembly 10 when going on a call. It also allows others to see assembly 10 or to see that it is missing if the fire/rescue person has forgotten to place assembly 10 on helmet ring 58.

If an injury or illness occurs which effects a fire/rescue person during an incident or while en route to or from an incident, assembly 10 may be turned over to emergency medical personnel so they can gain immediate access to important medical information about the injured or ill fire/rescue person.

Figure 2:
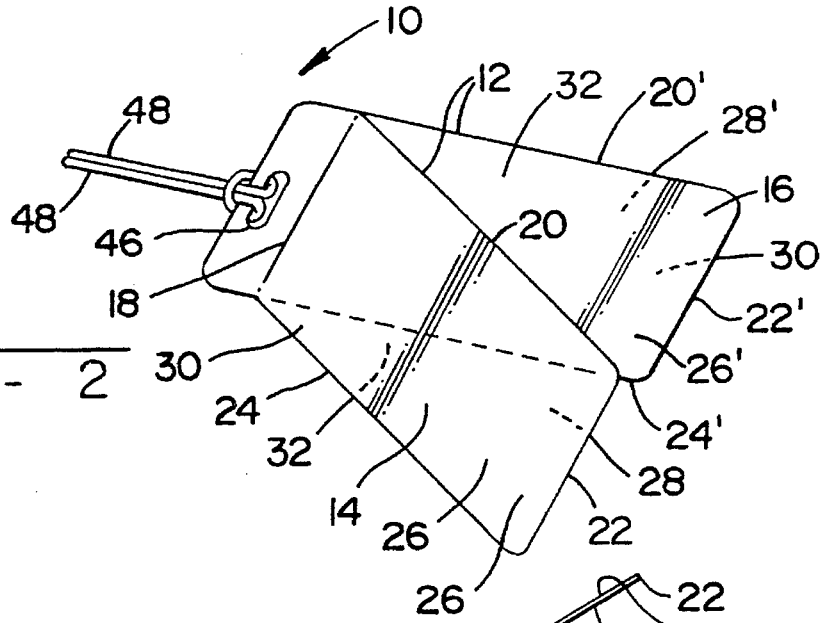
FIG. 2 is a fragmentary perspective view of the assembly shown in FIG. 1 and showing the assembly after portions thereof have been cut away to expose the information on the inside of the folded sheet of material.

To access the personal medical information contained within assembly 10, all that is needed is a pair of scissors or other cutting implement to gain access to the medical data within folded sheet 12. Assembly 10 is opened and the personal medical information is accessed by cutting portions of assembly 10 substantially along but within edges 20, 20', 22, 22', 24, 24' of portions 14, 16. The cut portions are then removed from assembly 10 and portions 14, 16 are opened about folded edge 18 to expose the personal medical information to view. See FIGS. 2 and 3. If medication 54 and/or element or elements 56 are a part of assembly 10, they are removed when portions 14, 16 are opened about folded edge 18. Shock cord 48 and connector 52 with ring 50 remain so that assembly 10 may be clipped to the injured/sick person's clothing. Although not specifically illustrated, it should be understood that folded sheet 12 may include pages or portions in addition to portions 14, 16. These additional pages or portions would be attached to and folded about edge 18 in a conventional manner. This would permit additional information to be carried by assembly 10.

Assembly 10 can be resealed by applying transparent adhesive tape (not shown) along edges 20, 20', 22, 22', 24, 24', and assembly 10 can be reused in the manner described until a new folded sheet 12 is issued and until a new assembly 10 is manufactured and laminated.

This invention provides for an identification and information carrying assembly for use with a fire/rescue personnel accountability system which provides a quick and easy means for gaining access to confidential emergency medical information and/or medication with respect to an individual fire/rescue person.

The invention in its broader aspects is not limited to the specific details shown and described, and departures may be made from such details without departing from the principles of the invention and without sacrificing its chief advantages.

What is claimed is:

1. An identification and information carrying assembly for use with a fire/rescue personnel accountability system, said assembly comprising:

a folded sheet of predetermined material defining first and second portions connected together along a folded edge in said material, each of said first and second portions further defining three additional edges;

said first and second portions each defining front and rear surfaces, said rear surface of said first portion facing and in contact with said front surface of said second portion when said first and second portions are folded together in closed relationship about said folded edge;

personal identification information located on said front surface of said first portion and/or on said rear surface of said second portion;

personal medical information located on said rear surface of said first portion and/or on said front surface of said second portion;

a first transparent sheet of thermoplastic material covering and extending beyond the edges of said first portion, and a second transparent sheet of thermoplastic material covering and extending beyond the edges of said second portion, said first and second sheets fused together along margins thereof adjacent to said edges of said first and second portions;

said fused transparent sheets defining an opening within a predetermined one of said fused margins adjacent to said folded edge;

a cord extending through said opening and fastened to said transparent sheets;

a connector attached to said cord; and medication positioned and removably held between said folded first and second portions.

2. An identification and information carrying assembly for use with a fire/rescue personnel accountability system, said assembly comprising:

a folded sheet of predetermined material defining first and second portions connected together along a folded edge in said material, each of said first and second portions further defining three additional edges;

said first and second portions each defining front and rear surfaces, said rear surface of said first portion facing and in contact with said front surface of said second portion when said first and second portions are folded together in closed relationship about said folded edge;

personal identification information located on said front surface of said first portion and/or on said rear surface of said second portion;

personal medical information located on said rear surface of said first portion and/or on said front surface of said second portion;

a first transparent sheet of thermoplastic material covering and extending beyond the edges of said first portion, and a second transparent sheet of thermoplastic material covering and extending beyond the edges of said second portion, said first and second sheets fused together along margins thereof adjacent to said edges of said first and second portions;

said fused transparent sheets defining an opening within a predetermined one of said fused margins adjacent to said folded edge;

a cord extending through said opening and fastened to said transparent sheets;

a connector attached to said cord; and information-containing micro film or micro fiche positioned and removably held between said folded first and second portions.

3. An identification and information carrying assembly for use with a fire/rescue personnel accountability system, said assembly comprising:

a folded sheet of predetermined material defining first and second portions connected together along a folded edge in said material, each of said first and second portions further defining three additional edges;

said first and second portions each defining front and rear surfaces, said rear surface of said first portion facing and in contact with said front surface of said second portion when said first and second portions are folded together in closed relationship about said folded edge;

personal identification information located on said front surface of said first portion and/or on said rear surface of said second portion;

personal medical information located on said rear surface of said first portion and/or on said front surface of said second portion;

a first transparent sheet of thermoplastic material covering and extending beyond the edges of said first portion, and a second transparent sheet of thermoplastic material covering and extending beyond the edges of said second portion, said first and second sheets fused together along margins thereof adjacent to said edges of said first and second portions;

said fused transparent sheets defining an opening within a predetermined one of said fused margins adjacent to said folded edge;

a cord extending through said opening and fastened to said transparent sheets;

a connector attached to said cord; and an information-containing laser disk positioned and removably held between said folded first and second portions.

4. An identification and information carrying assembly for use with a fire/rescue personnel accountability system, said assembly comprising:

a folded sheet of predetermined material defining first and second portions connected together along a folded edge in said material, each of said first and second portions further defining three additional edges;

said first and second portions each defining front and rear surfaces, said rear surface of said first portion facing and in contact with said front surface of said second portion when said first and second portions are folded together in closed relationship about said folded edge;

personal identification information located on said front surface of said first portion and/or on said rear surface of said second portion;

personal medical information located on said rear surface of said first portion and/or on said front surface of said second portion;

a first transparent sheet of thermoplastic material covering and extending beyond the edges of said first portion, and a second transparent sheet of thermoplastic material covering and extending beyond the edges of said second portion, said first and second sheets fused together along margins thereof adjacent to said edges of said first and second portions;

said fused transparent sheets defining an opening within a predetermined one of said fused margins adjacent to said folded edge;

a cord extending through said opening and fastened to said transparent sheets;

a connector attached to said cord; and an information-containing computer program positioned and removably held between said folded first and second portions.

5. A method of manufacturing an identification and information carrying assembly for use with a fire/rescue personnel accountability system, said method comprising the steps of:

providing a sheet of predetermined material;

folding said sheet along a folded edge in said material to form first and second portions connected together along said folded edge, each of said first and second portions further defining three additional edges;

placing personal identification information onto a front surface of said first portion and/or onto a rear surface of said second portion;

placing personal medical information onto a rear surface of said first portion and/or onto a front surface of said second portion;

positioning said first and second portions in closed relationship with each other by folding said first and second portions together about said folded edge;

placing a first transparent sheet of thermoplastic material over and extending beyond said edges of said first portion;

placing a second transparent sheet of thermoplastic material over and extending beyond said edges of said second portion;

fusing said first and second sheets together along margins thereof adjacent to said edges of said first and second portions;

creating an opening within a predetermined one of said fused margins adjacent to said folded edge;

positioning a cord through said opening and attaching said cord to said transparent sheets;

attaching a connector to said cord; and placing medication between said folded first and second portions prior to positioning said first and second portions in closed relationship with each other.

6. A method of manufacturing an identification and information carrying assembly for use with a fire/rescue personnel accountability system, said method comprising the steps of:

providing a sheet of predetermined material;

folding said sheet along a folded edge in said material to form first and second portions connected together along said folded edge, each of said first and second portions further defining three additional edges;

placing personal identification information onto a front surface of said first portion and/or onto a rear surface of said second portion;

placing personal medical information onto a rear surface of said first portion and/or onto a front surface of said second portion;

positioning said first and second portions in closed relationship with each other by folding said first and second portions together about said folded edge;

placing a first transparent sheet of thermoplastic material over and extending beyond said edges of said first portion;

placing a second transparent sheet of thermoplastic material over and extending beyond said edges of said second portion;

fusing said first and second sheets together along margins thereof adjacent to said edges of said first and second portions;

creating an opening within a predetermined one of said fused margins adjacent to said folded edge;

positioning a cord through said opening and attaching said cord to said transparent sheets;

attaching a connector to said cord; and placing information-containing micro film or micro fiche between said folded first and second portions prior to positioning said first and second portions in closed relationship with each other.

7. A method of manufacturing an identification and information carrying assembly for use with a fire/rescue personnel accountability system, said method comprising the steps of:

providing a sheet of predetermined material;

folding said sheet along a folded edge in said material to form first and second portions connected together along said folded edge, each of said first and second portions further defining three additional edges;

placing personal identification information onto a front surface of said first portion and/or onto a rear surface of said second portion;

placing personal medical information onto a rear surface of said first portion and/or onto a front surface of said second portion;

positioning said first and second portions in closed relationship with each other by folding said first and second portions together about said folded edge;

placing a first transparent sheet of thermoplastic material over and extending beyond said edges of said first portion;

placing a second transparent sheet of thermoplastic material over and extending beyond said edges of said second portion;

fusing said first and second sheets together along margins thereof adjacent to said edges of said first and second portions;

creating an opening within a predetermined one of said fused margins adjacent to said folded edge;

positioning a cord through said opening and attaching said cord to said transparent sheets;

attaching a connector to said cord; and placing an information-containing laser disk between said folded first and second portions prior to positioning said first and second portions in closed relationship with each other.

8. A method of manufacturing an identification and information carrying assembly for use with a fire/rescue personnel accountability system, said method comprising the steps of:

providing a sheet of predetermined material;

folding said sheet along a folded edge in said material to form first and second portions connected together along said folded edge, each of said first and second portions further defining three additional edges;

placing personal identification information onto a front surface of said first portion and/or onto a rear surface of said second portion;

placing personal medical information onto a rear surface of said first portion and/or onto a front surface of said second portion;

positioning said first and second portions in closed relationship with each other by folding said first and second portions together about said folded edge;

placing a first transparent sheet of thermoplastic material over and extending beyond said edges of said first portion;

placing a second transparent sheet of thermoplastic material over and extending beyond said edges of said second portion;

fusing said first and second sheets together along margins thereof adjacent to said edges of said first and second portions;

creating an opening within a predetermined one of said fused margins adjacent to said folded edge;

positioning a cord through said opening and attaching said cord to said transparent sheets;

attaching a connector to said cord; and placing an information-containing computer program between said folded first and second portions prior to positioning said first and second portions in closed relationship with each other.

* * * * *